US006073394A

United States Patent [19]

Uhl

[11] Patent Number: 6,073,394

[45] Date of Patent: Jun. 13, 2000

[54] DOOR SYSTEM

[75] Inventor: Albert Uhl, Sinzheim/Kartung, Germany

[73] Assignee: Kaba Gallenschütz GmbH, Bühl/Baden, Germany

[21] Appl. No.: 09/151,149

[22] Filed: Sep. 10, 1998

[30] Foreign Application Priority Data

Sep. 11, 1997 [DE] Germany ..... 197 39 820

[51] Int. Cl.[7] ..... E06B 3/34

[52] U.S. Cl. ..... 49/41; 49/42; 49/358; 49/360

[58] Field of Search ..... 49/358, 41, 40, 49/409, 360, 42; 109/73, 74, 78, 79, 47–49

[56] References Cited

U.S. PATENT DOCUMENTS

| | | | |
|---|---|---|---|
| 1,952,681 | 3/1934 | Peelle | 49/358 |
| 4,244,302 | 1/1981 | Stine | 49/41 X |
| 4,785,579 | 11/1988 | Sugiyama et al. | 49/40 |
| 4,843,761 | 7/1989 | Sandling | 49/41 |
| 5,566,505 | 10/1996 | Kamezaki | 49/358 X |
| 5,806,244 | 9/1998 | Tilli | 49/358 |

FOREIGN PATENT DOCUMENTS

| | | |
|---|---|---|
| 0 374 271 | 6/1990 | European Pat. Off. . |
| 1 016 158 | 9/1957 | Germany . |
| 92 14 915 | 4/1993 | Germany . |

OTHER PUBLICATIONS

Prospectus of the company Schmid Spezialantrieb for "Automatic Garage Sliding Door".

*Primary Examiner*—Daniel P. Stodola
*Assistant Examiner*—Hugh B. Thompson
*Attorney, Agent, or Firm*—Collard & Roe, P.C.

[57] ABSTRACT

A door system is driven by a motor. The door wings of this door system are guided by rollers (27) on a rail (10) secured in a door frame construction. The driving motor (30) of each door wing is secured onto an operating mechanism receiving the roller (27). It acts on the roller (27) in a positive manner or by friction-grip. The door system with the driving motor (30) fixedly arranged on the door wing and moving jointly with the door wing has a simpler structure as compared to known door systems, and can be manufactured and serviced at favorable cost.

8 Claims, 2 Drawing Sheets

DOOR SYSTEM

BACKGROUND OF THE INVENTION

1. Field of the Invention

The present invention relates to a door system with at least one door leaf or wing, which is guided on a rail by means of casters or rollers which are spaced from each other. This rail in turn is located on a frame construction. The door leaf is movable along the rail between an open position and a closed position by means of a driving motor.

2. The Prior Art

Door systems with door wings which can be driven by a motor between a closed position and an open position are known. For example, a door system of this type is described in the current prospectus "TALOS Karuselldrehtüren" [TALOS Carousel Revolving Doors] published by the Firm Kaba Gallenschütz GmbH, Nikolausu-Otto-Strasse I, D-77815 Bühl/Baden, Germany.

In such door systems, the wings of the door are driven by stationarily arranged driving motors via toothed belts. These belts are suitably guided over the range of movement of the door and are pivoted on the associated door wing, and moved into their respective open and closed positions.

Door systems with door wings driven via toothed belts are successfully used. However, such drives are complicated and consequently costly.

SUMMARY OF THE INVENTION

It is an object of the present invention to provide a door system of the type and for the purpose specified above, which has a door wing drive that is simple to construct and manufacturable at favorable cost.

This object is achieved according to the invention in that the door system has a driving motor and at least one caster or roller driven by such motor which are received in a mechanism which is joined with the door wing in a fixed manner.

Therefore, an essential feature of the invention is that the driving motor is attached to the associated door wing, as opposed to the stationary driving motors arranged in door systems of the prior art. Therefore it is jointly guided along when the door wing is driven between its closing and opening positions.

Sliding doors of various different designs can be equipped with these drives. It is important to make certain that the driving motor is adapted to the door system with respect to its size, type and intended purpose. A simple electric motor will suffice as the driving motor for many applications.

In another embodiment of the invention, the driving motor is flanged to a mounting holding the rollers, which supports the driven roller, and is equipped with driving means which positively or by friction-grip cooperate with the driven roller.

A suitable friction-grip driving connection between the driving shaft and the roller is produced by using a torsional friction wheel located on the end of the driving shaft which end is removed from the motor. This friction wheel cooperates with a edge flange circumferentially arranged on the roller to be driven. The contact pressure between the friction wheel and the edge flange is usefully selected in such a way that in the event a resistance occurs as the door wing is being operated or actuated, such resistance will not cause any damage. This resistance may be caused, for example by an object being in the path in which the door wing is guided, or by a person. The friction wheel will spin freely on the edge flange, so that any possible injury to a person or damage to the object or door is prevented. To obtain a good friction-grip, the friction wheel consists of an elastic material or is fitted with a tire or a coating made from such material.

In a further embodiment of the invention, the contact pressure between the friction wheel and the edge flange of the roller is adjustable, for example with the help of spring means. The spring force can be adjusted in a predetermined manner, and with the help of the spring, the roller is constantly pressed against the friction wheel with its edge flange.

In another embodiment, instead of a friction-grip connection between the driving motor and the roller, a positive connection is produced. This positive connection occurs in such a way that a pinion is arranged on the driving shaft of the driving motor. This pinion is actively connected with a mating toothed rim arranged on the roller. In this way, a reliable permanent driving connection is produced which is uniformly effective.

It is desirable to prevent damage even with a positive driving connection, for example if the door wing should collide with objects in the passage. Thus, it is useful to provide an additional slip coupling between the roller and the driving motor. This slip coupling will limit the transmission of the torque from the driving motor to the roller to a predetermined maximum value.

In a further embodiment, the driving motor is connected with an electronic remote control. This is preferable in large buildings or installations because separate closing or opening of each individual door is not required.

With door installations having two door wings arranged symmetrically relative to each other, it is preferable if both door wings are equipped with driving motors that are coordinated with each other.

In another embodiment, the door system serves as a night closure for a carousel-type revolving door. These night closures are used because revolving door installations are frequently equipped with locking elements which wholly or partly consist of glass. These locking elements can be easily damaged or overcome in the event of breaking and entering. Thus it is also useful for this reason to equip the body of the revolving door with an extra single-wing or two-wing door system. By means of this extra system the carousel-type revolving door is locked, for example during closing hours.

The door system of the invention is particularly suitable as a night closure. In this case, the rail extends along the roof of the carousel-type door, or along the floor. Door wings are guided on this rail by means of casters or rollers. The door wings are dimensioned in such a way that they completely seal the passageway or passage opening of the revolving door in its closed position. Also the door wings completely release the passageway in their open position.

In a further embodiment, the wings of the door form cylinder jacket segments which conform to the walls limiting the body of the carousel-type revolving door. In their closed position, the door wings thus form part of the cylinder jacket limiting the carousel revolving door installation. This is desirable because the locking element must not be set to a defined position before the night closure is actuated. Depending on the intended use of the door system or for an esthetic appearance, the door wings can be radially positioned on the outer side of the body of the carousel-type revolving door. The door wings may also be placed radially on the inner side, and guided by guide rails accordingly.

In another embodiment, the wing or wings of the door installation are equipped with a door-locking system, by means of which the wing or wings can be locked when the door is in its closed position. It is also preferable to use a remote control with such a door lock system.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
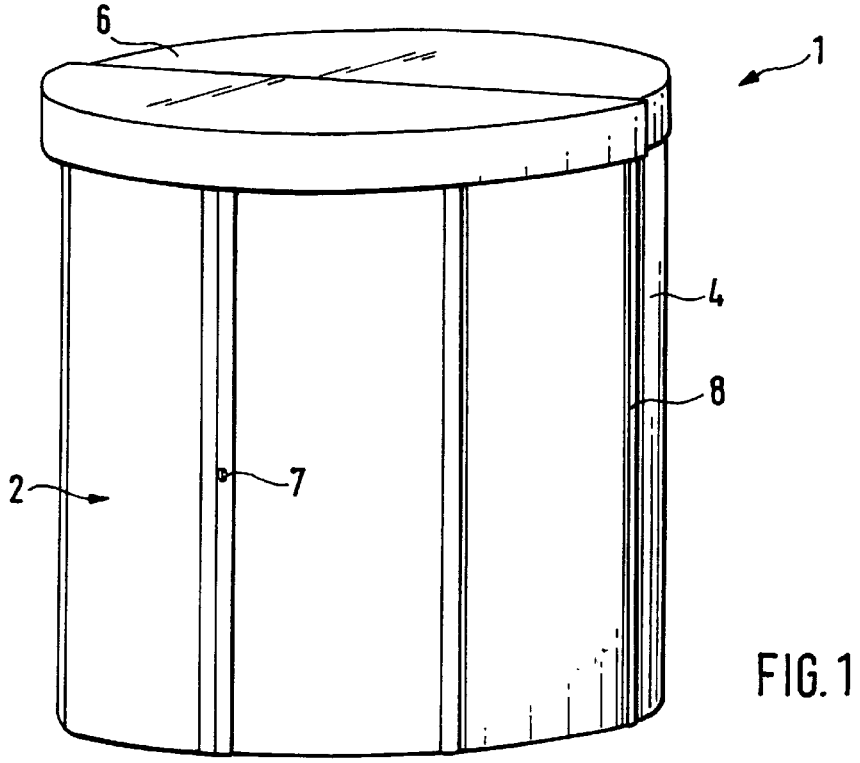
FIG. 1 shows a perspective view of the body of a carousel-type revolving door with a door system night closure for locking the revolving door.

Turning now to the detail of the drawings, FIG. 1 shows the body of a carousel-type revolving door 1, which is provided with an additional door system 2. System 2 is arranged on the body of carousel-type revolving door 1 on the outer side of the building. Preferably system 2 serves as a night closure for closing the body of the carousel-type revolving door as a whole, for example as protection against unauthorized access. Door system 2 can be locked by means of a door lock 7, which is not described here in detail.

Figure 2:
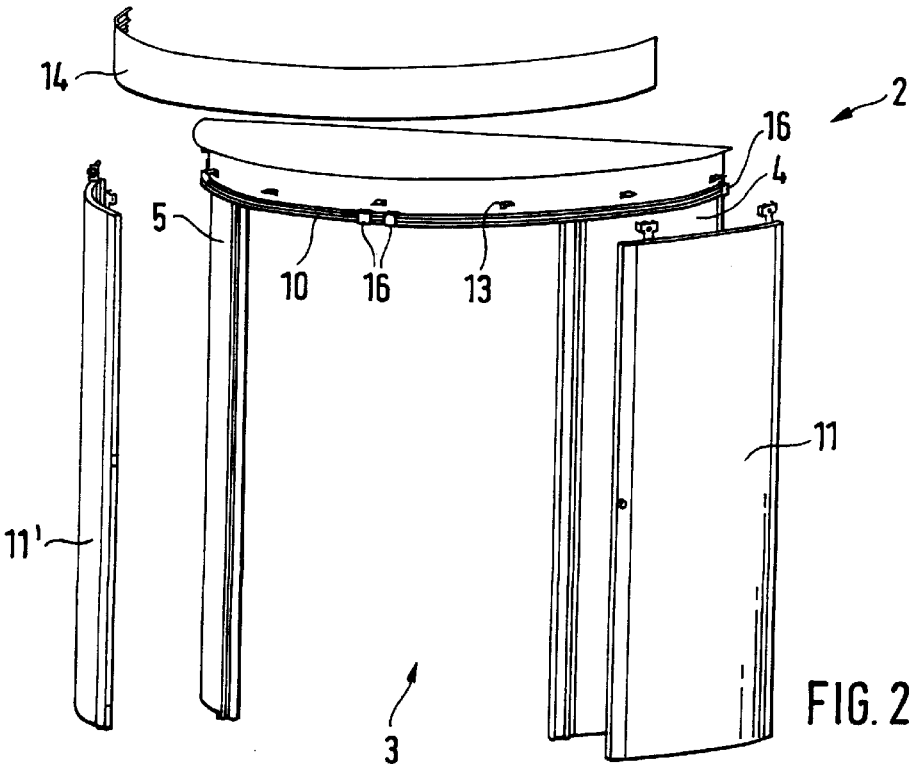
FIG. 2 shows an exploded view of the door system shown in FIG. 1.

The body of carousel-type revolving door 1 is shown in FIG. 2 and includes two cylinder jacket segment-shaped limiting walls 4 and 5, which oppose each other and which each release a passage 3. Also included is a top cover 6 with a circular cross section. Limiting walls 4 and 5 are each divided into cylinder jacket segment-shaped halves for facilitating the transport of the structural parts. These halves are joined with each other by means of connection flanges 8 projecting on the face sides. These connection flanges 8, however, are not described in detail here. Cover 6 includes two halves, which are detachably joined with each other. The body on the revolving door is equipped on the outer side of the building with a door system 2, which has two door wings having the shape of cylinder jacket-segments as well. When door system 2 is in the closed position, which is shown in FIG. 1, passage 3 of the carousel-type revolving door is completely closed by the two door wings or sections 11 and 11'. When door system 2 is in the opening or open-position, as shown is FIG. 2, however, the two door wings 11 and 11' are positioned radially on the outside relative to the two limiting walls 4 and 5 and completely release passage 3.

Figure 3:
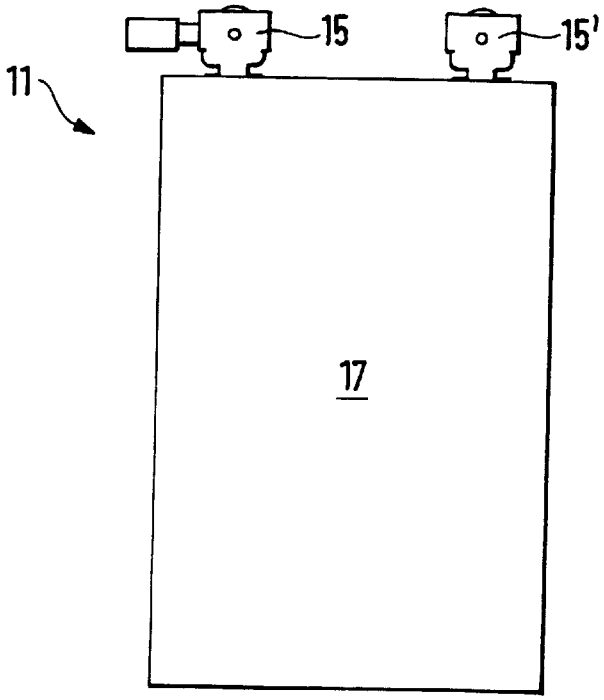
FIG. 3 shows a side view of a door wing of the door system shown in FIG. 1.

Door wings 11 and 11' are designed as sliding doors and are guided on a rail 10 by means of casters or rollers. This rail extends radially on the outer side from cover 6 in the form of a circular arc up into the range of limiting walls 4 and 5. For limiting the travel of one of the two door wings 11 and 11', stoppers 16 are positioned at each of the two ends of rail 10 as well as in the range of a center vertical plane or line of passage 3, with a spacing on both sides from this center plane. In their intended installed positions, door wings 11 and 11' with operating mechanisms 15 and 15' (FIG. 3) are covered within the range of cover 6 radially on the outer side by a facing 14. Facing 14 is mounted on anchors 13, which project from cover 6 with equal spacings between each other and vertically spaced from rail 10.

Figure 4:
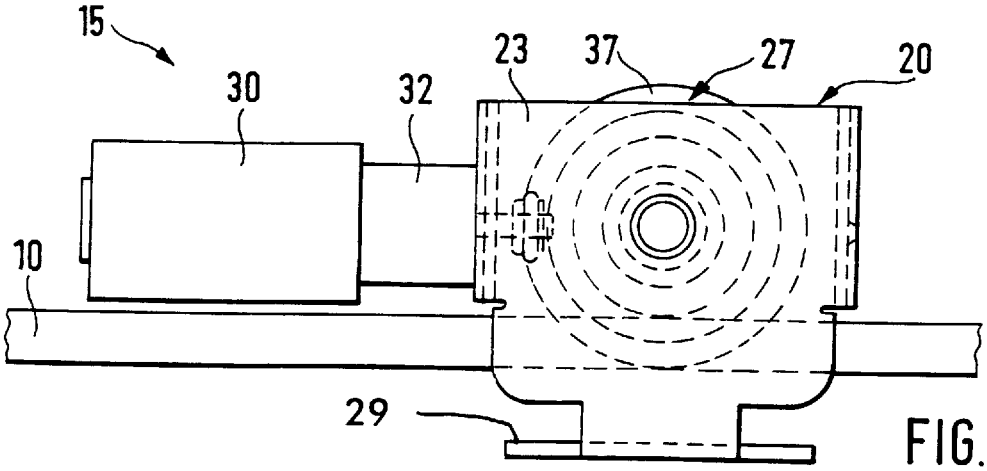
FIG. 4 shows a side view of an operating mechanism alone, which is mounted on the door wing shown in FIG. 3.
Figure 5:
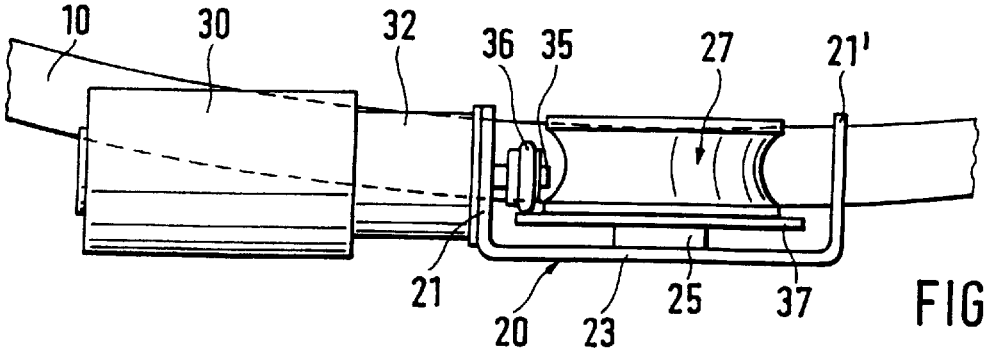
FIG. 5 shows a top view of the operating mechanism shown in FIG. 4.

The operating or running mechanisms 15 and 15' for guiding door wings 11 and 11' on rail 10 are shown in FIG. 4. They are rigidly but detachably secured onto the respective door leaf 17 of door wings 11 and 11', for example by means of screw connections. The two operating mechanisms 15 and 15' each include a U-shaped roller mounting 20 with two legs 21 and 21' as shown in FIG. 5. When rail 10 is in its installed position, legs 21 and 21' grip over rail 10 with a spacing from this rail. A bearing receptacle 25, which rotatably supports a roller 27, is secured on each of the bridges 23 connecting the two legs 21 and 21'.

Roller 27 has a radius which increases continuously on both sides of a center plane, forming a double track rim. Roller 27 is dimensioned in such a way that it grips over rail 10 with this track rim and is thus guided by the rail. At its lower end in the installed position, U-shaped roller mounting 20 has a mounting or securing section 29, which is joined with this lower end in one piece in the present exemplified embodiment. Door leaf 17 is secured on section 29 in a known manner.

A driving motor 30, which is actively connected with roller 27, is secured on operating mechanism 15. When door wing 11 and 11' is actuated and moved into the open or closed position, this motor participates in the movements of the door wing. Driving motor 30 is an electric motor, which is connected to a power supply by means of a spirally wound electric feed cable (not shown here), which thus can be elongated and contracted in the longitudinal direction of the spiral. Driving motor 30 is rigidly but detachably connected via a holding section 32 with leg 21 of roller mounting 20. Leg 21 grips over rail 10. Perpendicular to the axle of roller 27, a driving shaft 35 of driving motor 30 is extended through holding section 32 as well as through a bore of leg 21. With a front segment, shaft 35 projects into the inner zone of roller mounting 20. This inner zone is formed by the legs 21 and 21' and by bridge section 23. A friction wheel 36 is located so as to provide rotational movement to the front or head segment of driving shaft 35. Cooperating with an edge flange 37 of roller 27, this friction wheel 36 transmits a torque from driving shaft 35 to roller 27.

To assure an adequate friction-grip for moving door wing 11, friction wheel 36 may consist of an elastic material, for example rubber, or it is fitted with a tire or a coating consisting of a material with a high coefficient of friction. In a further embodiment between bearing 25 and bridge section 20, a suitable spring means can be provided for applying a constant pressure to bearing 25 and thus to roller 27. Thus the spring will contribute to the friction-grip by means of a predetermined force of contact pressure.

The contact pressure which produces the friction-grip has a magnitude which is determined so that in the event any resistance occurs when door wing 11 is moving, such resistance will not damage the door. This resistance may be caused, for example by an object present in the path along which the door is guided. Thus, friction wheel 36 will slip on edge flange 37, thus stopping the door wing. Damage to the door or to the object is avoided in this way.

While a few embodiments of the present invention have been shown and described, it is to be understood that many changes and modifications may be made thereunto without departing from the spirit and scope of the invention as defined in the appended claims.

What is claimed is:

1. A door system comprising at least one door wing (11,11');

at least one roller (27), each roller being spaced from every other roller, and said rail in turn being positioned on a frame construction of the door system comprising a revolving door installation (1) having passage areas (3) opposing each other which are limited by a cover (6) on a top side and cylinder jacket segment-shaped side walls (4,5); and at least one rail (10) secured in one of the passage areas (3) radially on an outer side or an inner side on the cover (6) for guiding at least one door wing (11,11') from an open position releasing the passage area (3) into a closed position sealing the passage area (3), said at least one roller guiding and supporting the door wing on the rail, the weight of the door wing being supported by said at least one roller on an upper portion of the rail;

a driving motor (30) for moving said door wing along the rail (10) between the open position and the closed position; and an operating mechanism (15) containing the driving motor (30) and said at least one roller (27) driven by said motor, said at least one roller being directly engageable by the motor; and said operating mechanism (15) rigidly connected on an upper surface of the door wing.

2. The door system according to claim 1, further comprising a roller mounting (20);

said driving motor (30) adjacent to said roller mounting (20) supporting the roller (27); and said driving motor (30) equipped with driving means (36) cooperating with the roller (27) in a manner selected from a group consisting of a positive manner and by a friction-grip.

3. The door system according to claim 1, comprising an electronic remote control actively connected with the driving motor.

4. The door system according to claim 1, comprising two driving motors (30) and two door wings (11, 11'); and said door wings movable in a direction opposite to each other by means of said two driving motors (30).

5. The door system according to claim 1, wherein each door wing has a radius and each side wall has a radius; and said door wing (11, 11') is cylinder jacket segment-shaped and the radius of said door wing conforms to the radius of the side walls (4, 5).

6. The door system according to claim 1, further comprising a remotely controllable door lock (7) for said door wing (11, 11');

said remotely controllable door lock (7) detachably connectable to said door wing in the closed position with a limiting wall (4, 5) of the frame construction or with another door wing (11, 11').

7. A door system comprising at least one door wing (11,11');

at least one roller (27) for guiding the door wing on a rail (10), each roller being spaced from every other roller, and said rail in turn being positioned on a frame construction of the door system;

a roller mounting (20) supporting the roller (27);

a driving motor (30) adjacent to said roller mounting (20) for moving said door wing along the rail (10) between an open position and a closed position, said driving motor (30) equipped with driving means (36) cooperating with the roller (27); and an operating mechanism (15) containing the driving motor (30) and said at least one roller (27) driven by said motor; and said operating mechanism (15) rigidly connected on an upper surface of the door wing;

wherein said driving motor (30) has a driving shaft (35);

wherein said driving means (36) is a friction wheel (36) connected by torsional pressure to an end of said driving shaft (35) facing away from the driving motor (30); and said friction wheel rests with predetermined contact pressure against an edge flange (37) radially projecting from the roller (27), and having a friction grip on said edge flange (37).

8. The door system according to claim 7, further comprising means for adjusting the contact pressure for controlling the friction-grip between the friction wheel (36) and the edge flange (37) of the roller (27).

* * * * *